US008608155B2

(12) United States Patent
Yatsunami et al.

(10) Patent No.: US 8,608,155 B2
(45) Date of Patent: Dec. 17, 2013

(54) PRINTING APPARATUS AND PRINTING METHOD

(75) Inventors: Tetsuji Yatsunami, Suwa (JP); Yoshikane Tsuchihashi, Suwa (JP); Akinobu Nakahata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/427,737

(22) Filed: Mar. 22, 2012

(65) Prior Publication Data

US 2012/0242038 A1 Sep. 27, 2012

(30) Foreign Application Priority Data

Mar. 23, 2011 (JP) ..... 2011-064563
Mar. 23, 2011 (JP) ..... 2011-064564

(51) Int. Cl.
*B65H 5/00* (2006.01)

(52) U.S. Cl.
USPC ..... 271/10.03; 271/10.11; 271/110; 271/265.01

(58) Field of Classification Search
USPC ..... 271/3.17, 3.18, 4.03, 4.08, 4.1, 10.03, 271/10.09, 10.11, 110, 265.01
See application file for complete search history.

(56) References Cited

FOREIGN PATENT DOCUMENTS

JP 2005-074766 A 3/2005

*Primary Examiner* — Michael McCullough
(74) *Attorney, Agent, or Firm* — Kilpatrick Townsend & Stockton LLP

(57) ABSTRACT

A printing apparatus and a printing method with the object of preventing the feed of a sheet that is not the feeding target when performing sheet re-feeding.

7 Claims, 9 Drawing Sheets

SHEET LENGTH L2 < PAPER FEEDING DISTANCE P

PRINTING APPARATUS AND PRINTING METHOD

BACKGROUND

This application claims priority to Japanese Patent Applications Nos. 2011-064563, filed Mar. 23, 2011 and 2011-064564, filed Mar. 23, 2011, the entireties of which are incorporated by reference herein.

1. Technical Field

The present invention relates to a printing apparatus which performs a sheet feeding operation.

2. Related Art

In the related art, a printing apparatus which transports a sheet to a printing head by a transport roller to perform printing is known. For example, the printing apparatus is provided with a path (also referred to as a transport path) from a sheet accommodating unit in which sheets are accommodated, via the lower portion of the printing head, to a sheet discharge port; and the transport roller is disposed on the transport path. The sheet set in the sheet accommodating unit is taken out by a separation roller, the sheet is transported downstream in the transport direction by a predetermined distance and transferred to the transport roller (such an operation is referred to as a sheet feeding operation).

When the sheet feeding operation is not appropriately performed, there is a case of performing the sheet feeding operation by driving an internal roller again (hereinafter, repetition of the sheet feeding operation is referred to as a sheet re-feeding operation or a retry operation). In the sheet feeding operation, an amount of transport for transporting the sheet by a predetermined distance is set in each roller. However, when the roller slides with respect to the sheet, the amount of transport is thereby reduced, and the predetermined amount of transport cannot be achieved. For this reason, to prevent failure of the sheet feeding operation, sheet re-feeding may be performed in which each roller is driven again to increase the amount of transport to transport the same sheet the predetermined distance, thereby completing the sheet feeding operation (for example, see JP-A-2005-74766).

By transporting the sheet by the predetermined distance using the sheet re-feeding operation, it is possible to accurately complete the sheet feeding operation, but an unnecessary sheet may be fed. For example, using the sheet re-feeding operation, the rotation of the separation roller is restarted, a sheet other than the feeding target sheet comes in contact with the separation roller, and the sheet may be fed.

SUMMARY

An advantage of some aspects of the invention is to provide a printing apparatus and a printing method to prevent a sheet other than a feeding target sheet from being fed in a sheet re-feeding operation.

According to an aspect of the invention, there is provided a printing apparatus which performs a sheet feeding operation of feeding a sheet to a predetermined position on a transport path by rotating a first roller, the printing apparatus including: a second roller that is disposed downstream in a transport direction as compared with the first roller transporting the sheet; and a sheet re-feeding unit that, in cases where the sheet feeding operation is performed, but the sheet has not been transported to the predetermined position, feeds the sheet using a first sheet re-feeding operation in which the first roller and the second roller are rotated, if the sheet length L2 in the direction of transporting the sheet≥an amount of transport L1 of the first roller; and that feeds the sheet using a second sheet re-feeding operation in which the second roller is rotated without rotating the first roller if the sheet length L2 in the direction of transporting the sheet<the amount of transport L1 of the first roller.

According to another aspect of the invention, there is provided a printing apparatus which performs a sheet feeding operation of feeding a sheet to a predetermined position on a transport path by rotating a first roller, the printing apparatus including: a second roller that is disposed downstream in a transport direction as compared with the first roller transporting the sheet; and a sheet re-feeding unit that, in cases where the sheet feeding operation is performed, but the sheet has not reached the predetermined position, feeds the sheet using a first sheet re-feeding operation in which the first roller and the second roller are rotated if a sheet length L2 in the direction of transporting the sheet≥the sheet feeding distance P; and that feeds the sheet using a second sheet re-feeding operation in which the first roller rotation is stopped and the second roller rotated if the sheet length L2 in the direction of transporting the sheet<the sheet feeding distance P, when a distance of feeding the sheet is the sheet feeding distance P.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in the following order.

1. First Embodiment
2. Second Embodiment
3. Other Embodiments

1. First Embodiment

Hereinafter, a printing apparatus according to a first embodiment of the invention will be described with reference to the drawings. Hereinafter, for example, the printing apparatus is the printer 11.

Figure 1:
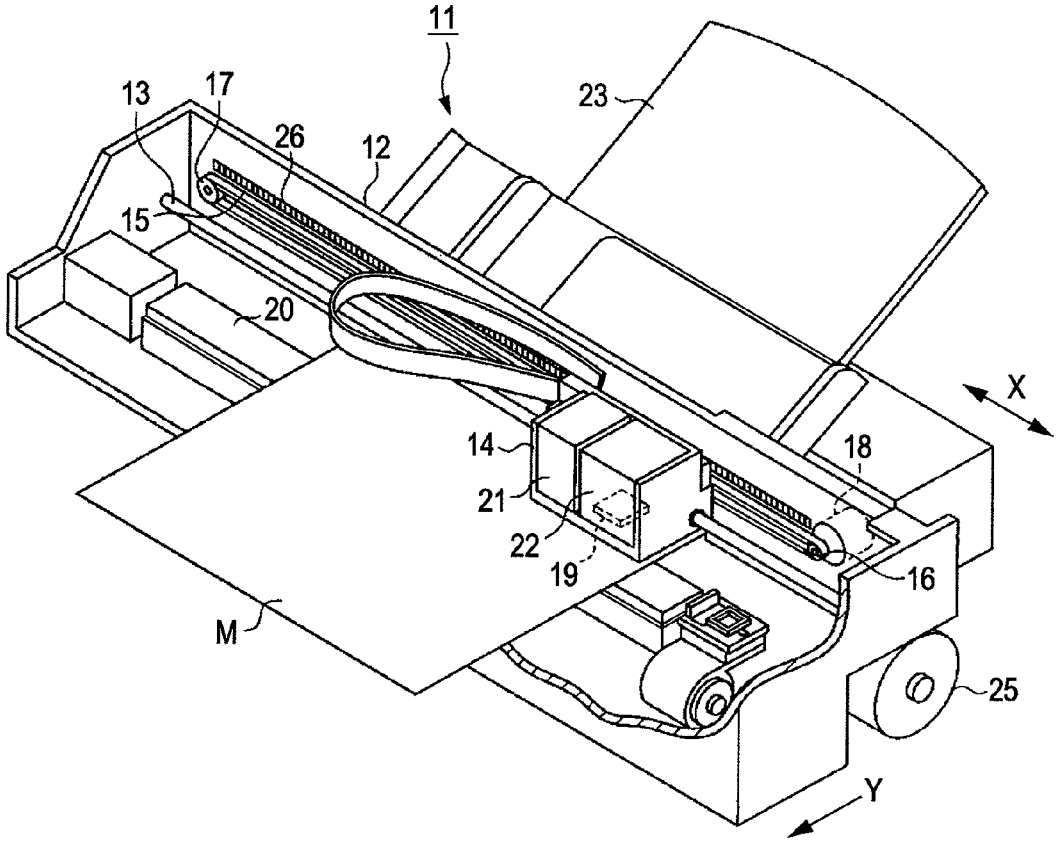
FIG. 1 is a perspective view illustrating printer from which the external case has been removed.

FIG. 1 is a perspective view illustrating the printer 11 from which the external case is removed. As shown in FIG. 1, the printer 11 is provided with a substantially rectangular box shaped body case 12 opened upward, and a guide shaft 13 provided in the body case 12 is provided with a carriage 14 to reciprocate along a main scanning direction X. An endless timing belt 15 to which the carriage 14 is fixed on the back side is wound on a pair of pulleys 16 and 17 provided on an inner face of a back plate of the body case 12, a carriage motor (hereinafter, referred to as "CR motor 18") as a driving unit, a driving shaft of which is connected to one pulley 16 is forwardly and reversely driven, and thus the carriage 14 reciprocates in the main scanning direction X.

A printing head (printing unit) 19 which ejects ink is provided under the carriage 14, and a platen 20 regulating a gap between the printing head 19 and a sheet M as a target is disposed to extend in the X direction, at a lower position opposed to the printing head 19 in the body case 12. Black and color ink cartridges 21 and 22 are detachably mounted on the carriage 14. The printing head 19 ejects (discharges) the ink of colors supplied from the ink cartridges 21 and 22, from nozzles of each color.

A sheet feeding tray 23 and an automatic sheet feeding device (Auto Sheet Feeder) which separates one sheet on the top from a plurality of sheets M stacked on the paper feeding tray 23 and supplies the sheet in a sub-scanning direction Y (direction from upstream side to downstream side in the transport direction) are provided on the back side of the printer 11.

A paper feeding motor (hereinafter, referred to as "PF motor 25") is provided at the lower right portion in FIG. 1 of the body case 12, the PF motor 25 is driven to rotate the transport roller and the sheet discharge roller (all shown in FIG. 2), and the sheet M is transported in the sub-scanning direction Y. In the printer 11, a printing operation of ejecting ink from the nozzles of the printing head 19 to the sheet M while reciprocating the carriage 14 in the main scanning direction, and a paper transport operation of transporting the sheet M in the sub-scanning direction Y by a predetermined amount of transport are substantially (however, operating timings are partially overlapped) repeated alternately to print texts and images on the sheet M.

In the printer 11, a linear encoder 26 that outputs a number of pulses proportional to the movement distance of the carriage 14 is provided to extend along the guide shaft 13, and a speed control and a position control of the carriage 14 are performed on the basis of a movement position, a movement direction, and a movement speed of the carriage 14 obtained using the output pulses of the linear encoder 26.

Figure 2:
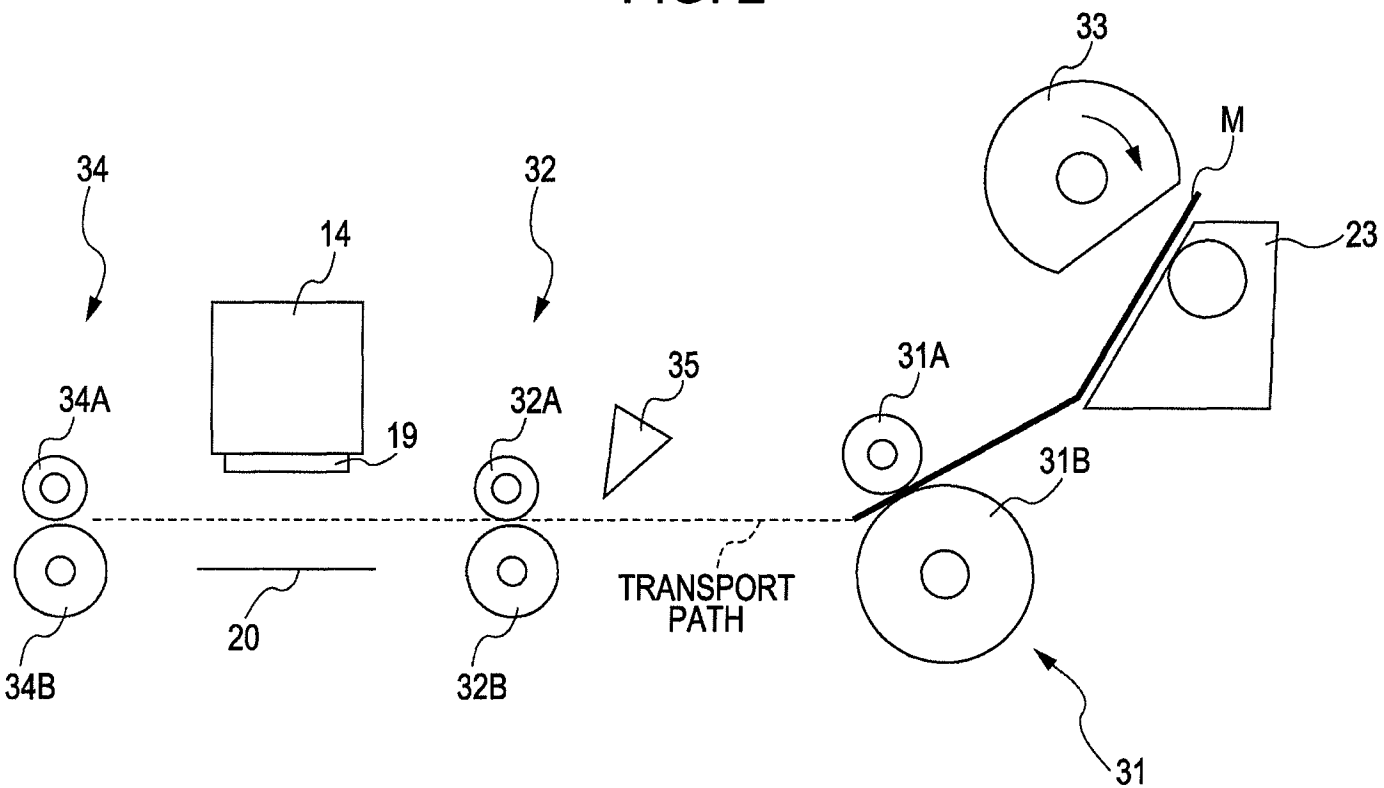
FIG. 2 is a side view illustrating a transport path of a sheet formed in the printer and various rollers disposed on the transport path.

FIG. 2 is a side view illustrating the transport path of the sheet M formed in the printer 11 and various rollers disposed on the transport path. As shown in FIG. 2, the printer 11 is provided therein with the transport path on which the sheets M stacked on the sheet feeding tray 23 are discharged to the outside through the platen 20. On the transport path, a separation roller 33 (first roller) separating the transport target sheet M from the plurality of sheets M stacked on the sheet feeding tray 23 is provided on the upstream side in the transport direction of the sheet feeding tray 23. The transport rollers (first transport roller 31 (second roller) and second transport roller 32) and a discharge roller 34 are rotatably provided before and after the printing position (that is, platen 20) of the printing head 19 are interposed therebetween in the transport direction on the downstream side in the transport direction of the separation roller 33.

The separation roller 33 is provided between the sheet feeding tray 23 and the upstream side of the first transport roller 31 in the transport direction, and is rotated by power transmitted from the PF motor 25 through a clutch unit (not shown). In the embodiment, a cross section of the separation roller 33 in the rotation direction is a half moon shaped cross section formed by partially cutting a circumference, and the length of the circumference portion is L1. For this reason, the separation roller 33 comes in contact with the sheet M on the sheet feeding tray 23 and rotates once, and the sheet M is wound by the rotation of the separation roller 33 in the transport direction and is ideally transported to the downstream side in the transport direction by the distance L1. Meanwhile, during a period (for example, period when a part formed by cutting a part of the circumferential portion is in a direction opposed to the sheet M) when the circumferential portion of the separation roller 33 releases the contact with the sheet M, the separation roller 33 does not come in contact with the sheet M, and thus the sheet M is not transmitted. Hereinafter, the position when the separation roller 33 starts coming in contact with the sheet M and the sheet feeding starts is referred to as a home position.

The transport rollers include the first transport rollers 31 and the second transport rollers 32 disposed on the transport path. Each transport roller includes a pair of a driving roller 31A (32A) and a driven roller 31B (32B). In the embodiment, the driving power of the PF motor 25 (see FIG. 1) is transmitted to the transport rollers, and both driving rollers 31A (32A) are driven to rotate. For this reason, the sheet M separated by the separation roller 33 is transmitted to the first transport rollers 31, and is transported in the left direction (sub-scanning direction Y) in FIG. 2.

The sheet discharge rollers 34 are disposed in the vicinity of the paper discharge port, and discharges the sheet M on which an image is formed to the outside of the printer 11 by the printing head 19. The paper discharge rollers 34 includes a pair of a driving roller 34A and a driven roller 34B, and the driven roller 34B is driven by the rotation of the driving roller 34A to discharge the sheet M.

A sheet detecting sensor 35 is provided at a position on the slightly upstream side of the second transport roller 32 in the transport direction. The sheet detecting sensor 35 is formed of, for example, a contact sensor (switch sensor), the leading end of the fed sheet M corresponds to a detection lever (not shown), the detection lever is displaced to be turned on, and the detection lever is turned off when the trailing end of the sheet M passes and the detection lever returns to the original waiting position by spring force. It is possible to determine whether or not the sheet M is present on the transport path by the sheet detecting sensor 35, and it is possible to detect that the sheet feeding operation is performed.

It is preferable that the sheet detecting sensor 35 may detect the end of the sheet M, and a non-contact sensor such as an optical sensor may be employed.

Figure 3:
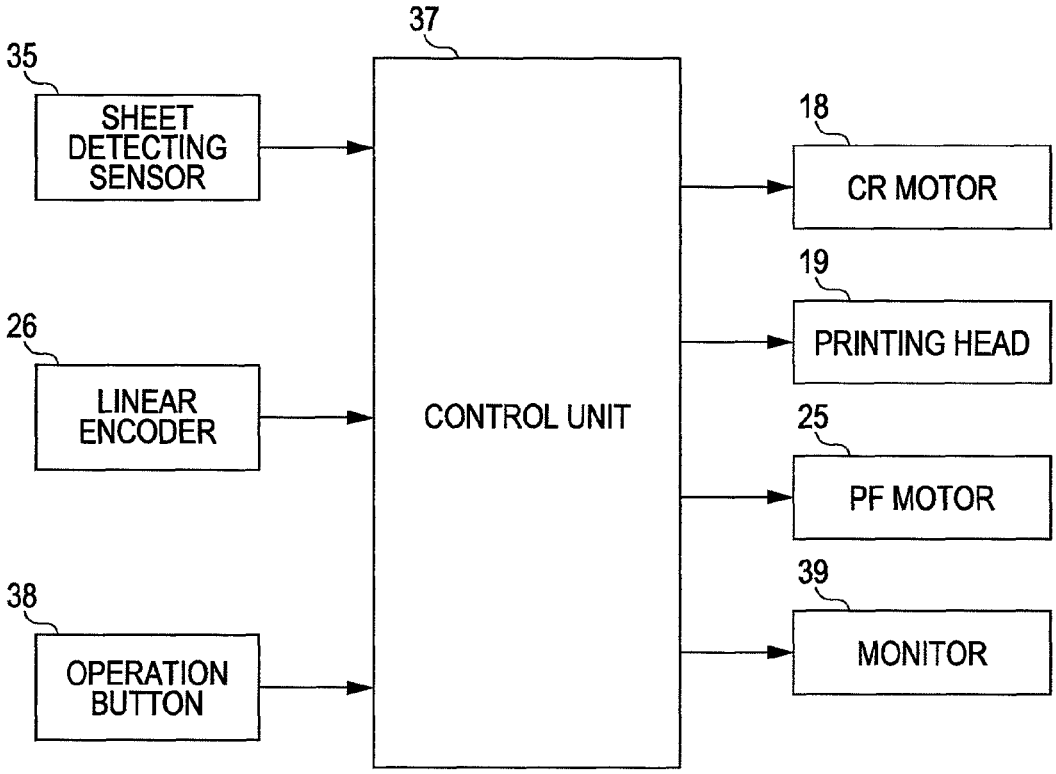
FIG. 3 is a block diagram illustrating a configuration of a control block of the printer.

FIG. 3 is a block diagram illustrating a configuration of a control block of the printer 11. As shown in FIG. 3, the printer 11 is provided with a control unit 37 formed of a microcomputer that generally controls the driving of the printer 11. The control unit 37 controls the driving of the CR motor 18, the printing head 19, and the PF motor 25 on the basis of the input from the sheet detecting sensor 35, the input from the linear encoder 26 (specifically, light reception side), and the input from an operation button 38 provided in the external case (not shown). The control unit 37 controls the display of a monitor 39 provided in the external case (not shown) on the basis of the inputs described above.

Figure 4:
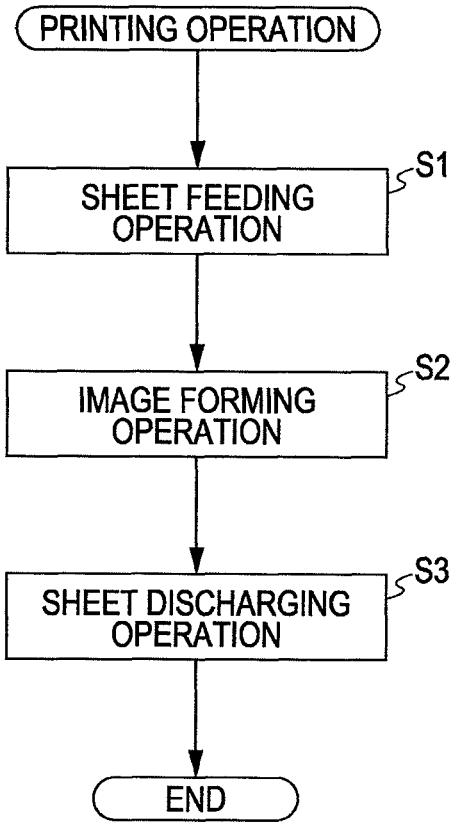
FIG. 4 is a flowchart illustrating a printing operation in the printer.

FIG. 4 is a flowchart illustrating a printing operation in the printer 11.

Hereinafter, in Step S1, the separation roller 33 is driven to take out the sheet M placed on the sheet feeding tray 23 and is transported downstream in the transport direction by a predetermined distance, and the sheet M is transferred to the first transport rollers 31 (hereinafter, such an operation is referred to as a sheet feeding operation and a sheet feeding process). In Step S2, the transport rollers move the sheet M in the sub-scanning direction (Y direction) while the carriage 14 moves the printing head 19 in the main scanning direction (X direction) with respect to the fed sheet M, thereby performing an image forming operation (image forming process). In Step S3, the sheet M on which the image is formed is discharged from the discharge port.

Figure 5A:
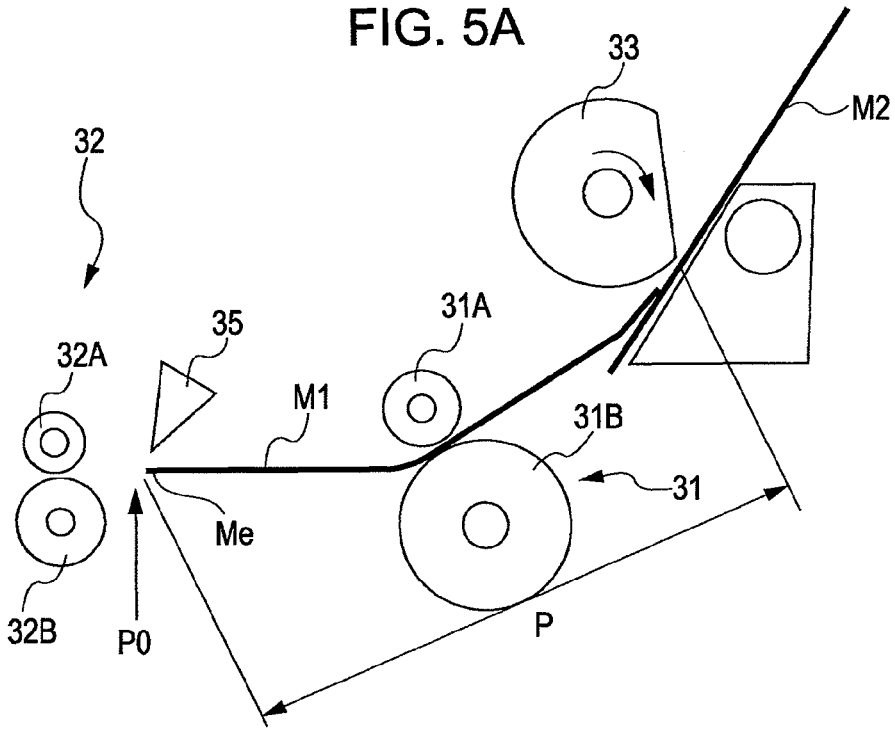
FIG. 5A and FIG. 5B are diagrams illustrating a sheet feeding operation performed in Step S1.
Figure 5B:
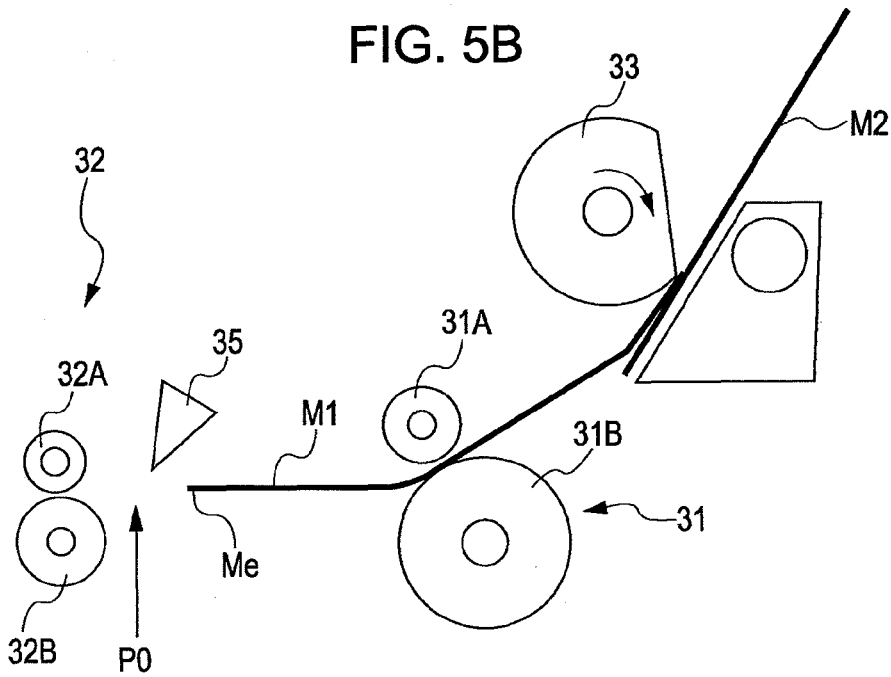

FIG. 5A and FIG. 5B are diagrams illustrating the sheet feeding operation performed in Step S1. As shown in FIG. 5A, in the sheet feeding operation, the end portion (hereinafter, merely referred to as sheet leading end Me) on the downstream side in the transport direction of the sheet M (hereinafter, when the sheet M is referred to as sheet M1, it is discriminated from sheets M2 stacked on the sheet feeding tray 23) taken out from the sheet feeding tray 23 is transmitted to a point P0 (hereinafter, the distance also referred to as sheet feeding distance P at which the sheet M is fed as described above). In the embodiment, the sheet feeding operation is completed by one rotation of the separation roller 33, and thus ideally, the amount of transport L1 is P. The amount of transport L1 represents a distance at which the separation roller 33 transports the sheet leading end Me to the point P0, and thus it is L1=Li×n (Li is the amount of transport by one rotation of the separation roller 33) when the separation roller 33 transports the leading end of the sheet M1 to the point P0 by n rotations. Similarly, even when the separation roller 33 feeds the sheet M1 to the sheet feeding distance P less than one rotation, an ideal amount of transport L1 is set by a circumference corresponding to a rotation angle of the separation roller 33. Since the sheet detecting sensor 35 is disposed at the point P0, the sheet detecting sensor 35 detects the sheet M1 when the sheet leading end Me reaches the point P0, and the control unit 37 determines the completion of the sheet feeding operation. For this reason, in the embodiment, the sheet feeding distance P may be a distance between the sheet detecting sensor 35 and the separation roller 33 on the transport path.

In the course of the sheet feeding operation, the separation roller 33 causes the sheet M1 to be slid, and thus the amount of transport L1 of the separation roller 33 may not be P. For example, it is a case where the sheet leading end Me does not reach the point P0 even when the sheet M1 does not follow the rotation of the separation roller 33 and the separation roller 33 is rotated once (FIG. 5B). In such a case, the control unit 37 rotates the separation roller 33 again, and performs a retry operation (sheet re-feeding operation) of repeating the sheet feeding operation.

In the retry operation, the separation roller 33 is rotated again after the rotation of the separation roller 33 is completed, and thus the sheet M (M2) other than the feeding target sheet may be fed. For example, the separation roller 33 transports the sheet M1 by the retry operation, but the separation roller 33 comes in contact with the next sheet M2 before the sheet leading end Me reaches P0, and the feeding of the sheet M2 may be started. For this reason, in the embodiment, in the retry operation, the form of the retry operation is changed according to conditions such that the sheet M2 that is not the feeding target is not fed.

Figure 6:
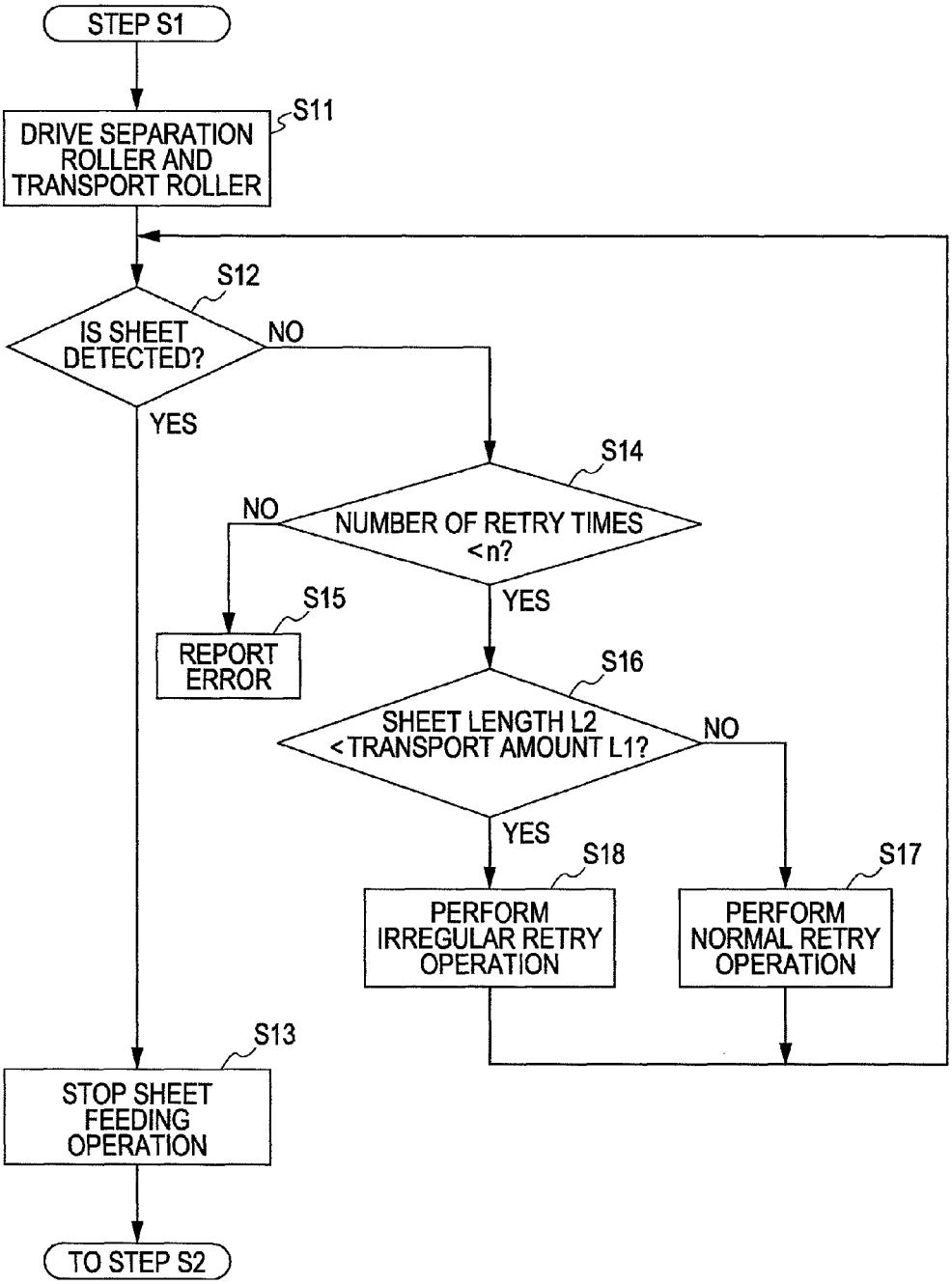
FIG. 6 is a flowchart illustrating in detail a sheet feeding operation of Step S1.

FIG. 6 is a flowchart illustrating in detail the sheet feeding operation of Step S1. Hereinafter, the sheet feeding operation according to the embodiment will be described with reference to the flowchart shown in FIG. 6. When a printing command is input to the printer 11, the control unit 37 drives the separation roller 33 and the transport rollers 31 and 32 to perform the sheet feeding operation in Step S11. The control unit 37 realizes the sheet re-feeding unit of the invention by the process shown in FIG. 6.

In Step S12, the control unit 37 determines whether or not the sheet leading end Me reaches the point P0. That is, the control unit 37 monitors the input of the sheet detecting sensor 35, the sheet detecting sensor 35 detects the sheet M, and the sheet feeding operation is completed in Step S13 when the input signal is changed to a high level (Step S12: Yes). In the embodiment, the control unit 37 stops the rotation of the separation roller 33, and transports the sheet M to the first transport roller 31.

Meanwhile, when the sheet leading end Me does not reach the point P0 even after a predetermined period is elapsed or the separation roller 33 is rotated once (Step S12: No), the control unit 37 determines that a sheet feeding failure occurs, and performs the retry operation in the following process.

For this reason, the control unit 37 determines the current number of retry times in Step S14, the process proceeds to Step S16 when the number of retry times is equal to or less than a threshold value n (Step S14: Yes). The determination of the number of retry times in Step S14 is that the control unit 37 determines whether or not the feeding target sheet is causing a paper jam. That is, when the sheet M causes a paper jam, the sheet M is not fed when the retry operation is repeated (the number of retry times>n), and thus the control unit 37 reports an error in Step S15 in such a case.

In Step S16, the control unit 37 selects any one of the first retry operation (first sheet re-feeding operation) and the second retry operation (second sheet re-feeding operation) on the basis of the condition represented by the following formula (1).

$$\text{Sheet Length } L2 < \text{Amount of Transport of Separation Roller } L1 \quad (1)$$

Herein, the length of the sheet M1 in the transport direction is, for example, a value determined on the basis of the size of the selected sheet M on a property screen at the time of starting the printing by the control unit 37. For example, when "A4" is selected (sheet size: 210 mm×297 mm) as the sheet M and the sheet is transported such that the short side (the side of 210 mm) of the sheet M crosses the transport direction (Y direction), the length L2 in the transport direction is "297 mm".

When the length L2 of the sheet M in the transport direction is equal to or more than the amount of transport L1 (Step S16: No), the control unit 37 selects the normal retry operation in Step S17. In the normal retry operation, the separation roller 33 and the transport rollers 31 and 32 are rotated to transport the sheet M to the downstream side in the transport direction similarly to the normal sheet feeding operation. In the embodiment, since the outer circumference of the separation roller 33 is a fan shape, the separation roller 33 is rotated to the home position, and then the separation roller 33 comes in contact with the sheet M again to perform the sheet re-feeding operation. Then, the process proceeds to Step S12, and when the sheet M is detected by the sheet detecting sensor 35, the process proceeds to Step S13, and the sheet feeding operation is completed. Of course, the normal retry operation is repeated until the sheet detecting sensor 35 detects the sheet M (Step S12: Yes).

Meanwhile, when the length L2 of the sheet M in the transport direction is equal to or more than the amount of transport L1 (Step S16: Yes), the control unit 37 proceeds to Step S18 and selects an irregular retry operation. In the irregular retry operation, the retry operation is performed such that the sheet (M2 in FIG. 5A and FIG. 5B) other than the feeding target is not fed.

Figure 7A:
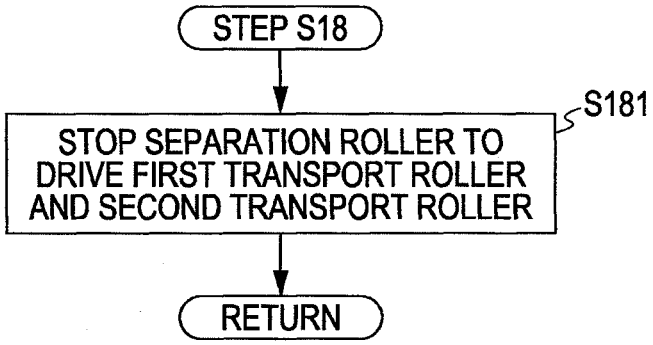
FIG. 7A and FIG. 7B are diagrams illustrating an irregular retry.
Figure 7B:
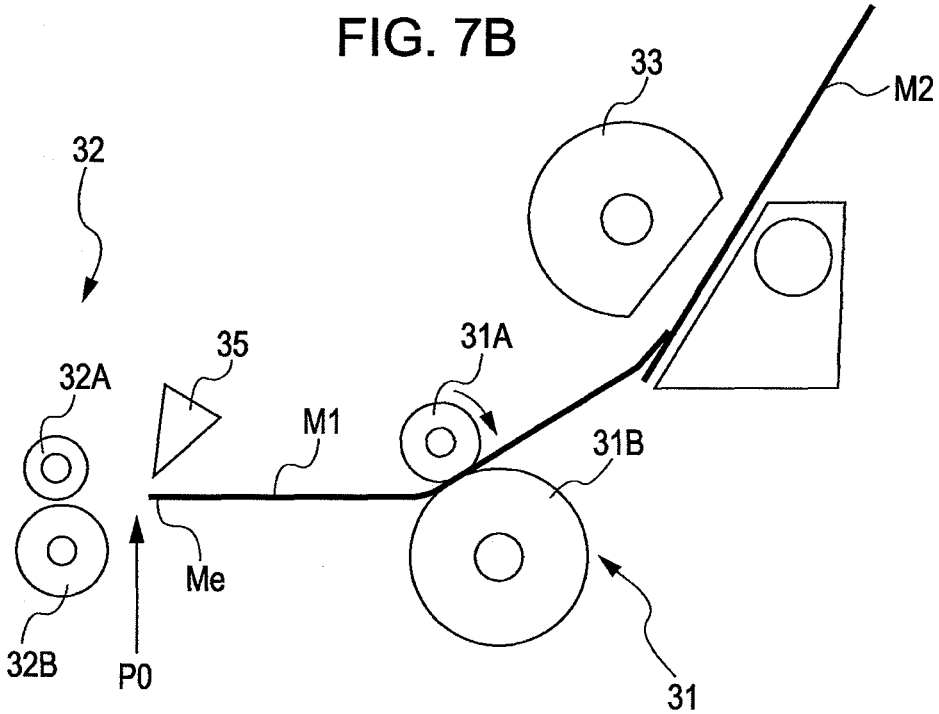

FIG. 7A and FIG. 7B are diagrams illustrating the irregular retry. FIG. 7A is a flowchart (Step S181) illustrating the irregular retry operation performed in Step S18. FIG. 7B is a diagram illustrating the irregular retry operation. In the irregular retry operation shown in FIG. 7A and FIG. 7B, the control unit 37 stops the rotation of the separation roller 33, and rotates only the first transport roller 31 and the second transport roller 32 to perform the sheet feeding operation. That is, in the irregular retry operation, the feeding of the sheet M1 is performed only by the first transport roller 31, and the separation roller 33 is not involved. For this reason, in the irregular retry operation, the separation roller 33 does not rotate, and thus it is possible to prevent the sheet (M2) other than the feeding target from being fed.

Hereinafter, returning to Step S12, when the sheet detecting sensor 35 detects the sheet M (Step S12: Yes), the sheet feeding operation is completed (Step S13), and the process proceeds to Step S2 shown in FIG. 4. Meanwhile, when the sheet detecting sensor 35 does not detect the sheet M (Step S12: No), the irregular retry operation is repeated again (Step S18).

As described above, in the printer 11 according to the first embodiment, when the sheet feeding failure occurs, the form of the retry operation of solving the sheet feeding failure is selected on the basis of the relationship between the sheet length L2 and the amount of transport L1 of the separation roller 33. That is, when the sheet length L2 is equal to or less than the amount of transport L1, the sheet M is re-fed without rotating the separation roller 33 in the retry operation. For this reason, even when the fed sheet M has any size, it is possible to prevent the sheet M other than the feeding target from being fed.

2. Second Embodiment

Figure 8:
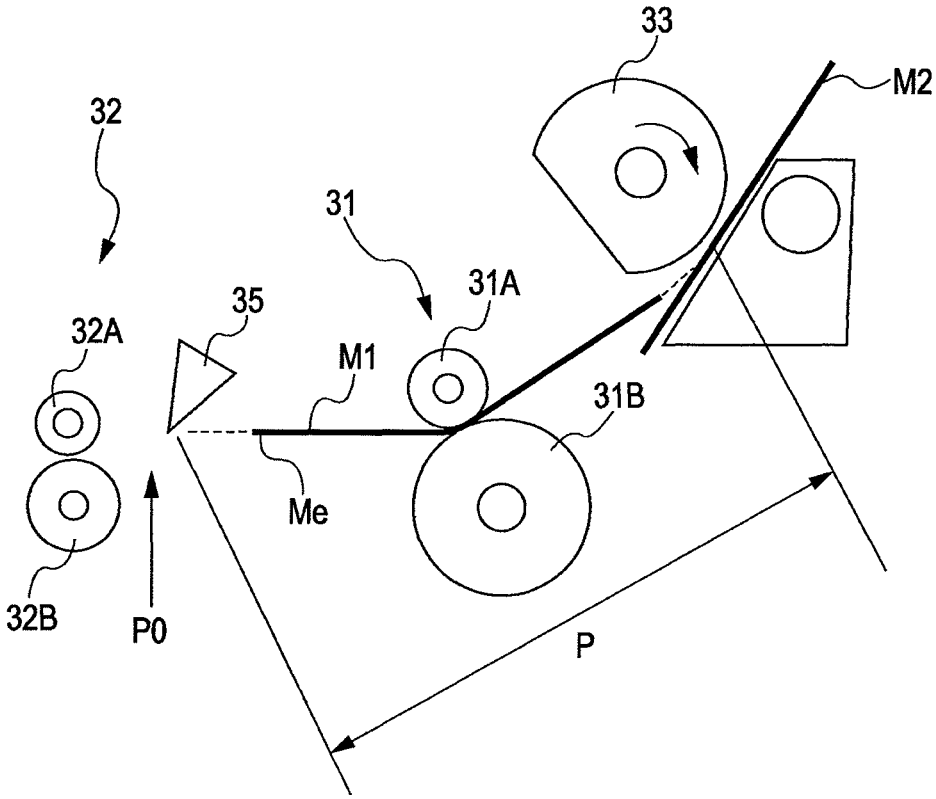
FIG. 8 is a diagram illustrating a positional relationship of the rollers and the sheet of the printer according to a second embodiment.

The condition of selecting the retry operation may be determined on the basis of the relationship between the sheet length L2 and the sheet feeding distance P, in addition to the relationship between the sheet length L2 and the amount of transport L1 of the separation roller 33. FIG. 8 is a diagram illustrating a positional relationship of rollers and sheets M of the printer 11 according to the second embodiment.

In the printer 11 described in the second embodiment, when the printing is performed on the sheet M of the sheet feeding distance P>the sheet length L2, the sheet feeding operation is performed in cooperation of the separation roller 33 and the first transport roller 31. That is, as shown in FIG. 8, when the sheet M1 of the sheet feeding distance P>L2 is fed, the sheet leading end Me does not reach the point 0 even when the feeding of the separation roller 33 is performed until the contact between the sheet M1 and the separation roller 33 is released. For this reason, in the printer 11, even after the contact between the separation roller 33 and the sheet M1 is released, the sheet M1 is transported to the sheet feeding distance P by the rotation of the first transport roller 31. After the contact between the separation roller 33 and the sheet M1 is released, the part formed by partially cutting the circumference of the separation roller 33 is positioned to be opposed to the sheet M2, and thus the rotation is kept to the home position without the contact between the sheet M2 and the separation roller 33.

Since it is preferable that the sheet feeding distance P be a distance that the leading end Me of the sheet M1 is fed, the sheet feeding distance P may be a distance of an actual path, in addition to a linear distance shown in FIG. 8.

When the retry operation is performed in the printer 11 with such a configuration, the retry operation is repeated during a predetermined period, the separation roller 33 is rotated over the home position, the circumferential portion comes in contact with the sheet M2 again, and thus the sheet M2 may be fed. For this reason, in the second embodiment, a retry operation of preventing the problem described above is performed.

Figure 9:
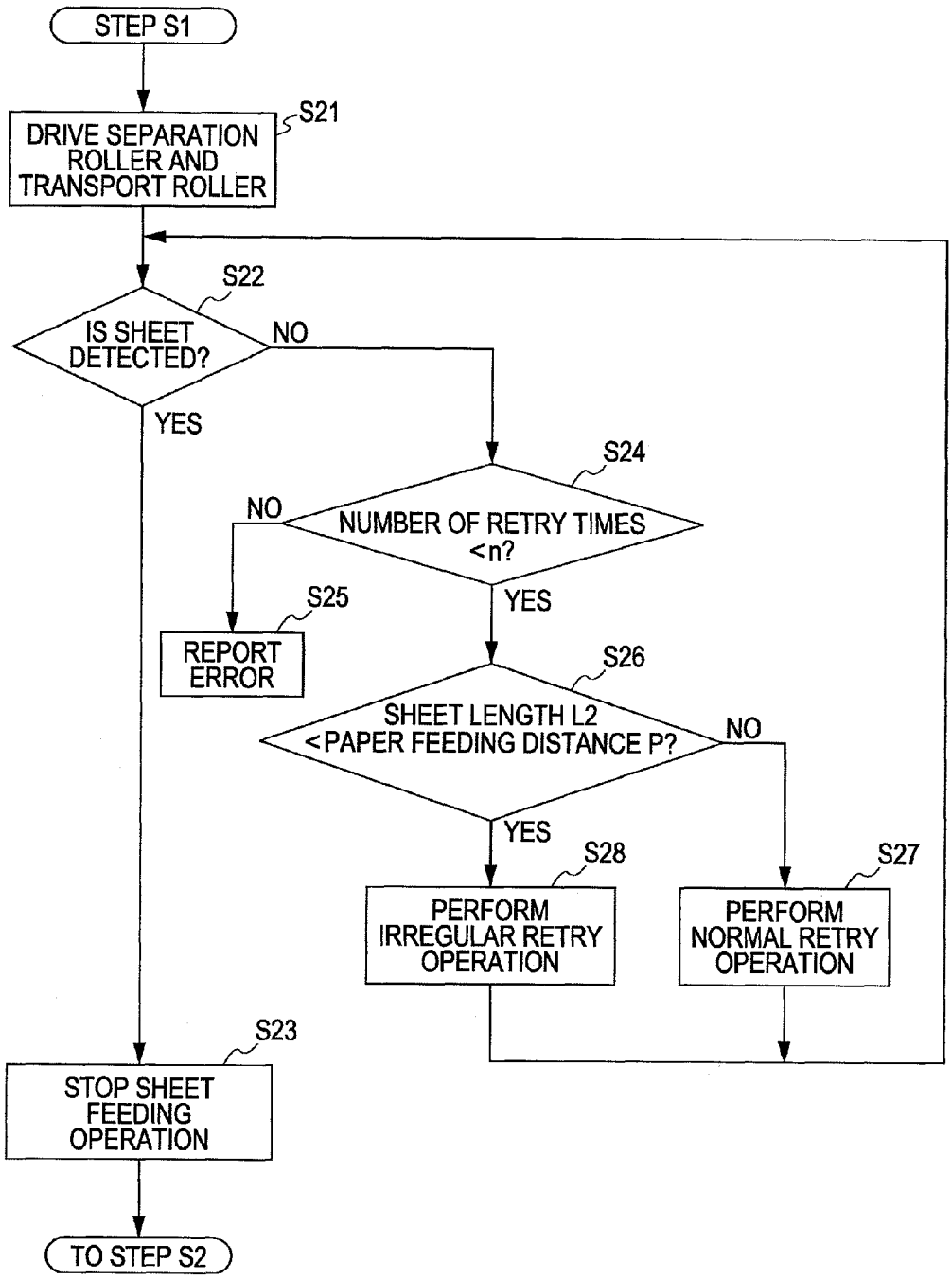
FIG. 9 is a flowchart illustrating in detail a sheet feeding operation according to the second embodiment.

FIG. 9 is a flowchart illustrating in detail the sheet feeding operation according to the second embodiment. The process shown in FIG. 9 is different in conditions of determining the retry operation from that of the first embodiment.

When a printing command is input to the printer 11, the control unit 37 drives the separation roller 33 and the transport rollers 31 and 32 to perform the sheet feeding operation in Step S21. In Step S22, the control unit 37 determines whether or not the sheet leading end Me reaches the point P0. For this reason, when the sheet leading end Me does not reach the point P0 even after a predetermined period is elapsed or the separation roller 33 is rotated once (Step S22: No), the control unit 37 determines that a sheet feeding failure occurs, and performs the retry operation in the following process.

The control unit 37 determines the current number of retry times in Step S24, the process proceeds to Step S26 when the number of retry times is equal to or less than a threshold value n (Step S24: Yes). In Step S26, the control unit 37 selects any one of the normal retry operation and the irregular retry operation on the basis of the condition represented by the following formula (2).

$$\text{Sheet Length } L2 < \text{Sheet Feeding Distance } P \quad (2)$$

Herein, the sheet feeding distance P is different for each printer 11, and has to be preset according to the form of the used printer 11. The length of the sheet M in the transport direction is determined by the sheet shape set as the printing target similarly to the first embodiment.

When the length L2 of the sheet M in the transport direction is equal to or more than the sheet feeding distance P (Step S26: No), the control unit 37 selects the normal retry operation in Step S27. As for the sheet M of the sheet length L2>the sheet feeding distance P, the sheet M is fed by the rotation of the separation roller 33, and the normal retry operation is as described in the first embodiment. Then, the process proceeds to Step S22, and when the sheet M is detected by the sheet detecting sensor 35, the process proceeds to Step S23, and the sheet feeding operation is completed.

Meanwhile, when the length L2 of the sheet M in the transport direction is equal to or more than the sheet feeding distance P (Step S26: Yes), the control unit 37 proceeds to Step S28 and selects an irregular retry operation. As for the sheet M of the sheet length L2<the sheet feeding distance P, the separation roller 33 is detached from the sheet M in the course of the sheet feeding and a period of performing the sheet feeding only by the first transport roller 31 occurs, but the form of the irregular retry operation is as described in the first embodiment. That is, in the irregular retry operation according to the second embodiment, the control unit 37 stops the rotation of the separation roller 33, and rotates only the first transport roller 31 and the second transport roller 32 to perform the sheet feeding operation. That is, in the irregular retry operation, the feeding of the sheet M1 is performed only by the first transport roller 31.

Hereinafter, returning to Step S22, when the sheet detecting sensor 35 detects the sheet M (Step S22: Yes), the sheet feeding operation is completed (Step S23), and the process proceeds to Step S2 shown in FIG. 4. Meanwhile, when the sheet detecting sensor 35 does not detect the sheet M (Step S22: No), the irregular retry operation is repeated again (Step S28).

As described above, in the printer 11 according to the second embodiment, even when the sheet M having the sheet length L2 shorter than the sheet feeding distance P in the printer 11 is fed, it is possible to prevent the sheet M other than the feeding target from being fed in the retry operation.

3. Other Embodiments

The invention may be realized by various embodiments.

The shape of the separation roller 33 is not limited to the shape formed by partially cutting the circumference. That is, the separation roller 33 may have a shape in which a cross section in the rotation direction is circular.

The number of transport rollers used in the printer 11 is not limited to the number described in the embodiments.

In addition, it is obvious that the invention is not limited to the embodiments described above. That is, the following are disclosed as one embodiment of the invention, for example, the combination of the members and configurations which are disclosed in the embodiments and can be replaced by each other is appropriately modified and applied, the members and configurations which can be replaced by the members and configuration disclosed in the embodiments are appropriately replaced and the combination thereof is modified and applied as the know technique although not disclosed in the embodiments, and the member and configurations are replaced by members and configurations which can be assumed as substitution of the members and configurations disclosed in the embodiments by a person skilled in the art on the basis of the known technique and the combination thereof is modified and applied.

What is claimed is:

1. A printing apparatus which performs a sheet feeding operation of feeding a sheet to a predetermined position on a transport path by rotating a first roller, the printing apparatus comprising:

a second roller that is disposed downstream in a transport direction as compared with the first roller transporting the sheet;

a sheet detecting sensor that detects a sheet disposed at the predetermined position, wherein the sheet detecting sensor detects the sheet to complete the sheet feeding operation; a control unit formed of a microcomputer which stores a sheet length L2 as a parameter used to determine when the sheet length L2 in the direction of transporting the sheet is either greater than or equal to an amount of transport L1 of the first roller or less than the amount of transport L1 of the first roller; and a sheet re-feeding unit that, in cases where the sheet feeding operation is performed, but the sheet has not been transported to the predetermined position, feeds the sheet using a first sheet re-feeding operation in which the first roller and the second roller are rotated, if the sheet length L2 in the direction of transporting the sheet≥the amount of transport L1 of the first roller; and that feeds the sheet using a second sheet re-feeding operation in which the second roller is rotated without rotating the first roller if the sheet length L2 in the direction of transporting the sheet<the amount of transport L1 of the first roller.

2. The printing apparatus according to claim 1, wherein the sheet re-feeding unit reports an error representing a sheet feeding failure when the first sheet re-feeding operation or the second sheet re-feeding operation has been repeated a predetermined number of times.

3. The printing apparatus according to claim 1, wherein the first roller transports the sheet by the amount of transport L1 in one rotation.

4. The printing apparatus according to claim 1, wherein the sheet length L2 is determined on the basis of a size selected on a property screen at the time of starting the sheet feeding operation.

5. A printing apparatus which performs a sheet feeding operation of feeding a sheet to a predetermined position on a transport path by rotating a first roller, the printing apparatus comprising:

a second roller that is disposed downstream in a transport direction as compared with the first roller transporting the sheet;

a sheet detecting sensor that detects a sheet disposed at the predetermined position, wherein a sheet feeding distance P is a distance between the sheet detecting sensor on the transport path and the first roller; a control unit formed of a microcomputer which stores a sheet length L2 as a parameter used to determine when the sheet feeding distance P is either greater than or equal to an amount of transport L1 of the first roller or less than the sheet feeding distance P; and a sheet re-feeding unit that, in cases where the sheet feeding operation is performed, but the sheet has not reached the predetermined position, feeds the sheet using a first sheet re-feeding operation in which the first roller and the second roller are rotated if the sheet length L2 in the direction of transporting the sheet≥the sheet feeding distance P; and that feeds the sheet using a second sheet re-feeding operation in which the first roller rotation is stopped and the second roller rotated if the sheet length L2 in the direction of transporting the sheet<the sheet feeding distance P, when a distance of feeding the sheet is the sheet feeding distance P.

6. The printing apparatus according to claim 5, wherein the sheet re-feeding unit reports an error representing a sheet feeding failure when the first sheet re-feeding operation or the second sheet re-feeding operation is repeated a predetermined number of times.

7. The printing apparatus according to claim 5, wherein the sheet length L2 is determined on the basis of a size selected on a property screen at the time of starting the sheet feeding operation.

* * * * *